US007721716B1

(12) United States Patent
Harwood

(10) Patent No.: US 7,721,716 B1
(45) Date of Patent: May 25, 2010

(54) HIGH PRESSURE PIEZOELECTRIC FUEL INJECTOR

(76) Inventor: Michael R. Harwood, 166 Lewis Mountain Rd, New Market, AL (US) 35761

( * ) Notice: Subject to any disclaimer, the term of this patent is extended or adjusted under 35 U.S.C. 154(b) by 0 days.

(21) Appl. No.: 12/502,423

(22) Filed: Jul. 14, 2009

Related U.S. Application Data

(60) Provisional application No. 61/081,174, filed on Jul. 16, 2008.

(51) Int. Cl.
*F02M 37/08* (2006.01)

(52) U.S. Cl. ..... 123/498; 123/495

(58) Field of Classification Search ..... 123/495, 123/497, 498; 310/315, 341–346
See application file for complete search history.

(56) References Cited

U.S. PATENT DOCUMENTS

| | | | | | |
|---|---|---|---|---|---|
| 3,753,426 | A * | 8/1973 | Lilley | 123/447 |
| 4,095,580 | A | 6/1978 | Murray et al. | 123/32 SJ |
| 4,635,849 | A | 1/1987 | Igashira et al. | 239/102.2 |
| 4,649,886 | A * | 3/1987 | Igashira et al. | 123/498 |
| 4,770,138 | A | 9/1988 | Onishi | 123/276 |
| 4,784,102 | A | 11/1988 | Igashira et al. | 123/447 |
| 4,939,405 | A * | 7/1990 | Okuyama et al. | 310/330 |
| 4,958,610 | A | 9/1990 | Yamamoto | 123/478 |
| 5,004,945 | A * | 4/1991 | Tomita et al. | 310/328 |
| 5,130,598 | A | 7/1992 | Verheyen et al. | 310/316 |
| 5,271,362 | A | 12/1993 | Kobayashi et al. | 123/299 |
| 5,482,213 | A * | 1/1996 | Matsusaka et al. | 239/584 |
| 5,740,782 | A | 4/1998 | Lowi, Jr. | 123/446 |
| 6,146,102 | A * | 11/2000 | Otome et al. | 417/45 |
| 6,244,525 | B1 | 6/2001 | Gallup et al. | 239/533.12 |
| 6,279,842 | B1 | 8/2001 | Spain | 239/585.1 |
| 6,293,255 | B1 * | 9/2001 | Otome et al. | 123/498 |
| 6,464,149 | B1 | 10/2002 | Hardy et al. | 239/102.2 |
| 6,520,423 | B1 | 2/2003 | Ricci-Ottati et al. | 239/89 |
| 6,568,602 | B1 | 5/2003 | Bram et al. | 239/5 |
| 6,760,212 | B2 | 7/2004 | Cheever, Jr. et al. | 361/160 |
| 6,772,963 | B2 | 8/2004 | Neretti et al. | 239/102.2 |
| 7,309,027 | B2 | 12/2007 | Magel et al. | 239/88 |
| 7,373,927 | B2 | 5/2008 | Vorbach | 123/499 |
| 7,438,050 | B2 * | 10/2008 | Allen | 123/436 |
| 7,464,689 | B2 | 12/2008 | Siewert | 123/299 |
| 7,533,655 | B2 * | 5/2009 | Allen | 123/436 |
| 2005/0034707 | A1 * | 2/2005 | Augustin | 123/446 |
| 2009/0020101 | A1 | 1/2009 | Posselt et al. | 123/458 |
| 2009/0260599 | A1 * | 10/2009 | Venkataraghavan et al. | 123/498 |

* cited by examiner

*Primary Examiner*—Erick Solis
(74) *Attorney, Agent, or Firm*—James Richards

(57) ABSTRACT

A combined injector and fuel pump suitable for high pressure direct injection of heavy fuels into Diesel engines, in particular small light weight Diesel engines as may be used in small aircraft. The injector utilizes a piezoelectric actuator driving a piston assembly comprising an inlet reed check valve disposed thereon. Fuel enters an inlet port coupled to an inlet chamber on a first side of the piston. Piezoelectric actuator contraction transfers fuel from the inlet chamber through the reed valve to the pressurization chamber on a second side of the piston. Piezoelectric actuator expansion drives the piston to pressurize the fuel in the pressurization chamber, which forces open a conical annular valve and nozzle assembly injecting a finely atomized mist of fuel into the cylinder.

20 Claims, 12 Drawing Sheets

HIGH PRESSURE PIEZOELECTRIC FUEL INJECTOR

RELATED APPLICATIONS

This application claims the benefit under 35 USC 119(e) of provisional application Ser. No. 61/081,174, Titled "Fuel Injector", filed Jul. 16, 2008 by Harwood. All of the above listed U.S. Patent and Patent Applications are hereby incorporated herein by reference in their entirety.

FIELD OF THE INVENTION

The present invention pertains generally to the field of internal combustion engines, more particularly to the field of fuel injection systems for internal combustion engines.

BACKGROUND OF THE INVENTION

Typical injectors for a Diesel engine operate in conjunction with a heavy, high pressure pump to operate the injector. The systems are well suited to the large diesel engines in trucking, automotive and marine service, however the systems scale poorly for smaller engines or where light weight is needed as in aircraft applications. As engine size decreases, the injectors and injector pump do not scale proportionately. The engine ends up with a significant fraction of the total weight invested in the injection system. Thus, there is a need for simple light weight injector systems and pump systems for small and light weight applications.

BRIEF DESCRIPTION OF THE INVENTION

Briefly, the present invention relates to a combined injector and fuel pump suitable for high pressure direct injection of heavy fuels into Diesel engines, in particular small light weight Diesel engines as may be used in small aircraft. The injector utilizes a piezoelectric actuator driving a piston assembly comprising an inlet reed check valve disposed thereon. Fuel enters an inlet port coupled to an inlet chamber on a first side of the piston. Piezoelectric actuator contraction transfers fuel from the inlet chamber through the reed valve to the pressurization chamber on a second side of the piston. Piezoelectric actuator expansion drives the piston to pressurize the fuel in the pressurization chamber, which forces open a conical annular valve and nozzle assembly injecting a finely atomized mist of fuel into the cylinder.

In one aspect of the invention, the injector is adapted to receive fuel at low pressure, including gravity feed pressures.

In another aspect the injector may be adapted to deliver fuel by direct injection into a cylinder at high pressure during a combustion interval.

In another embodiment, the injector may be adapted to accurately deliver very low quantities of fuel per stroke.

In another aspect of the invention, the output valve and injector spray nozzle features are integrated into the same structure and utilize the same components.

In another aspect of the invention, the injector may direct the spray pattern at a thirty degree angle with respect to a plane perpendicular to the injector axis.

In a further feature, the output valve/injector nozzle may have adjustable spring tension.

In a further feature of the invention, the nozzle generates fine atomization without requiring protrusions into the combustion chamber that tend to collect carbon deposits.

In a further feature, the nozzle presents a substantially flush and rugged face to the combustion chamber for minimum combustion gas flow disturbance and minimum deposit buildup.

In a further feature of the invention, the injector spray nozzle comprises a flexible metal cap having a conical face matching a conical face of the nozzle portion of the injector housing and filling the depression in the injector reed valve, bringing the injector exposure to a substantially continuous level with the cylinder head surface. The injector directly injects fuel at a desired angle into the cylinder, avoiding protrusions within the cylinder subject to carbon deposit buildup.

In a further aspect of the invention, the actuator length dimension is coupled to the piston to move the piston to compress a volume of fuel to cause injection. In one embodiment, the width dimension is decoupled from the fluid by a close fitting piston or by O-rings or other sealants.

In a further aspect of the invention, the actuator is coupled to the piston by an axial coupling having rotational decoupling to minimize torque transmitted to the actuator, for example, a flexible coupling, a spherical dome coupling, a contact coupling. The coupling may be spring loaded to provide return motion.

In a further embodiment, the input reed valve seat includes small holes for fuel transfer. The holes should be small enough so that full pressure on the reed does not flex the reed enough across the span of the hole under maximum peak pressure to cause long term fatigue concerns in the reed. Standard stress strain analysis may be used to determine the strain, which is then compared with known fatigue properties for the reed material.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF EXEMPLARY EMBODIMENTS OF THE INVENTION

The injector of the present invention eliminates the need for large, heavy high-pressure fuel pumps while maintaining the fine atomization consistent with the needs of state-of-the-art direct fuel injection systems. The high pressure necessary for the fine atomization is produced by a piezoelectric actuator driven piston. Piezoelectric actuators are found to be exceptionally well suited for very small heavy fuel (VSHF) engine injectors. Piezoelectric actuators may also be referred to as piezoelectric transducers, or PZT's. While the actuation distance of piezoelectric actuators is often small (10-100 micrometers (μm)), the injection volume of injectors designed for very small (i.e. ~20 cubic centimeters (cc)) engines is also very small 1 to 2 cubic millimeters (1-2 $mm^3$) per stroke at maximum power output. In addition, the piezoelectric actuator is adapted to produce relatively large forces in a compact package, and consequently, are able to create high pressures on the order of three thousand psi (200 bar) (1 bar=100 kPa) consistent with the needs of a Diesel engine. Exemplary piezo actuators may P-841.20 manufactured by Physik Instrumente. The present invention eliminates the need for a separate high pressure pump by the use of piezoelectric actuators as a driver for a compact high pressure impulse pump integrated with an injector nozzle assembly.

The present invention is an enabling technology for small engines burning heavy fuels. A plunger pressurization mechanism is built into the injector itself eliminating the high-pressure fuel pump typical of most diesel injection systems, while maintaining the atomization consistent with state-of-art injectors. A piezoelectric actuator is used to both provide a compact pressurization mechanism and rapid, precision control of the injection pulse to ensure that the proper amount of fuel is injected at the proper time.

Figure 1B:
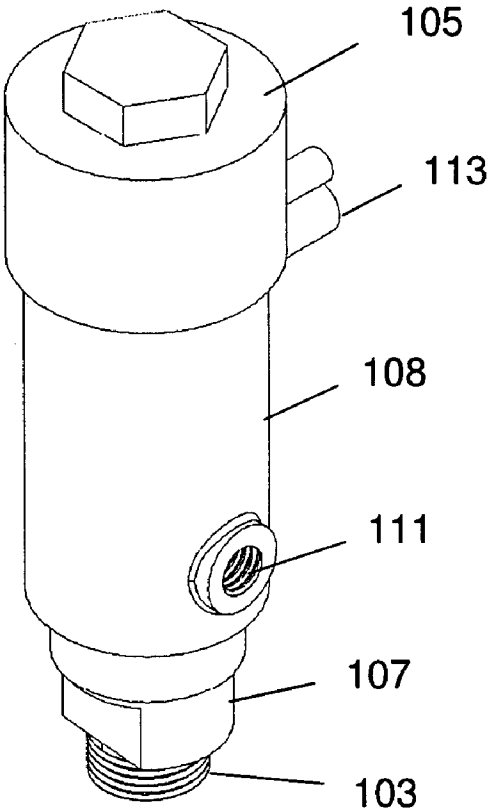
FIG. 1B illustrates a perspective view of the injector of FIG. 1A.
Figure 1A:
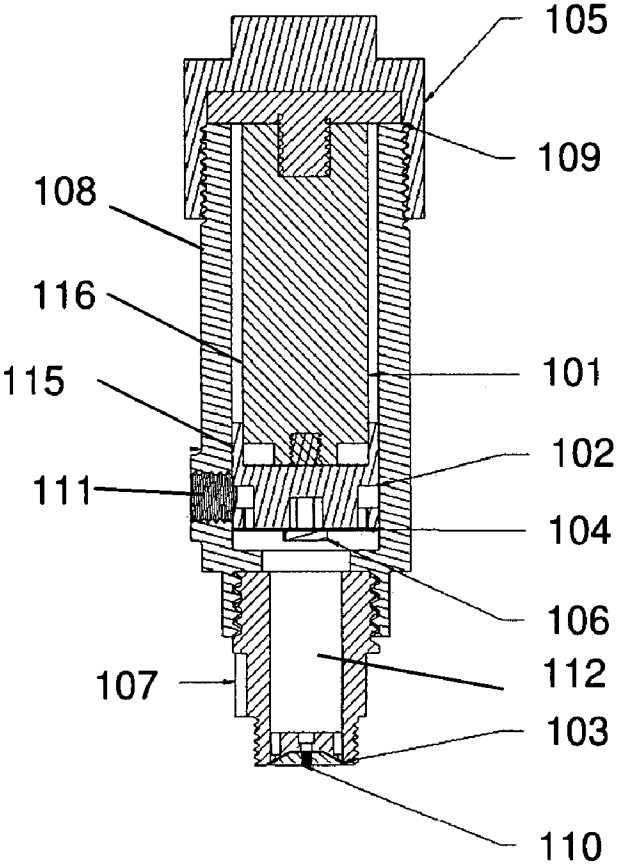
FIG. 1A illustrates a cross section view of an exemplary high pressure piezoelectric actuated impulse pump and fuel injector in accordance with the present invention.
Figure 2:
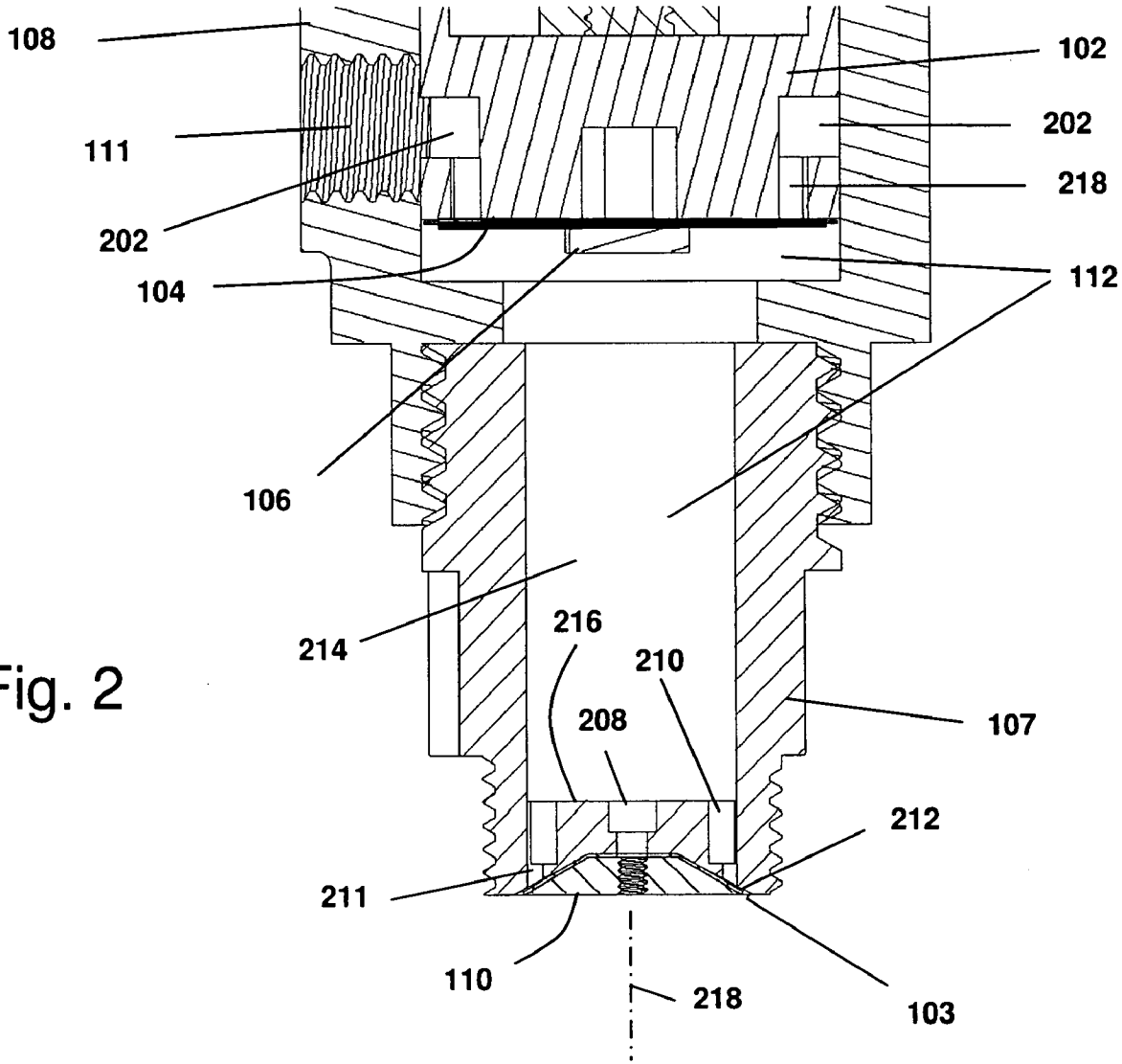
FIG. 2 illustrates a detail cross section view of the lower portion of FIG. 1A
Figure 3B:
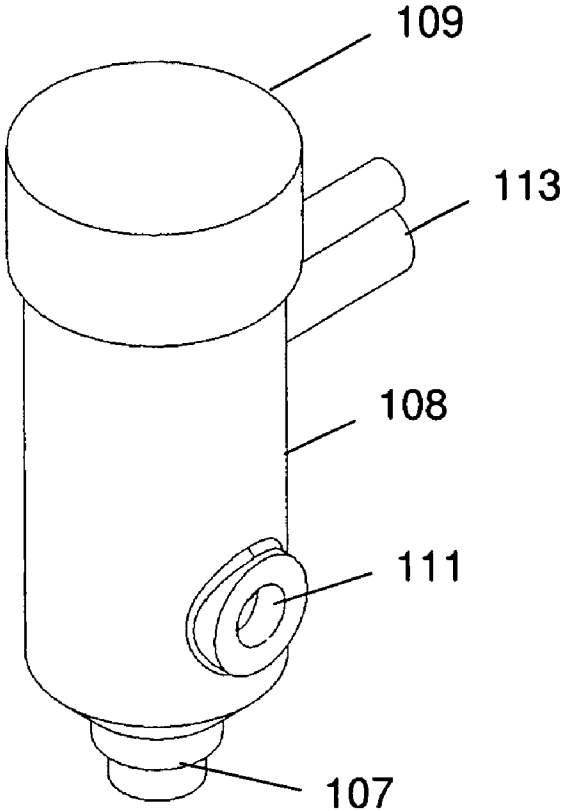
FIG. 3B illustrates a perspective view of the injector of FIG. 3A.
Figure 3A:
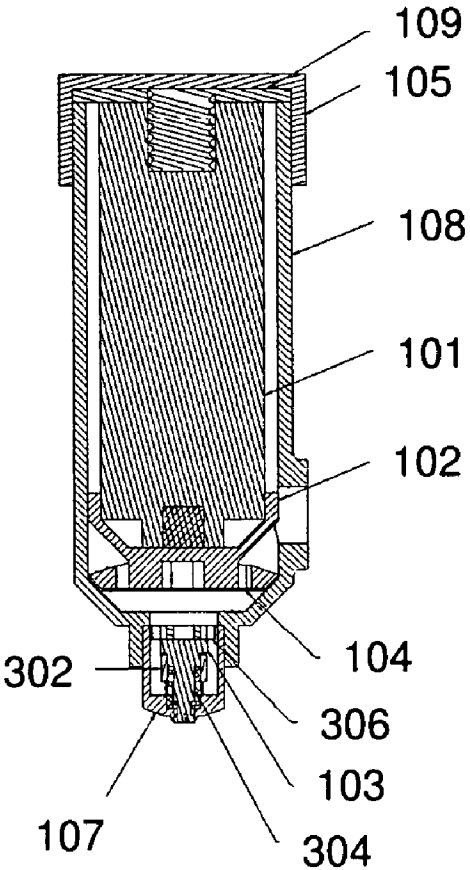
FIG. 3A illustrates a cross section view of an alternative exemplary high pressure piezoelectric actuated impulse pump and fuel injector in accordance with the present invention.
Figure 4:
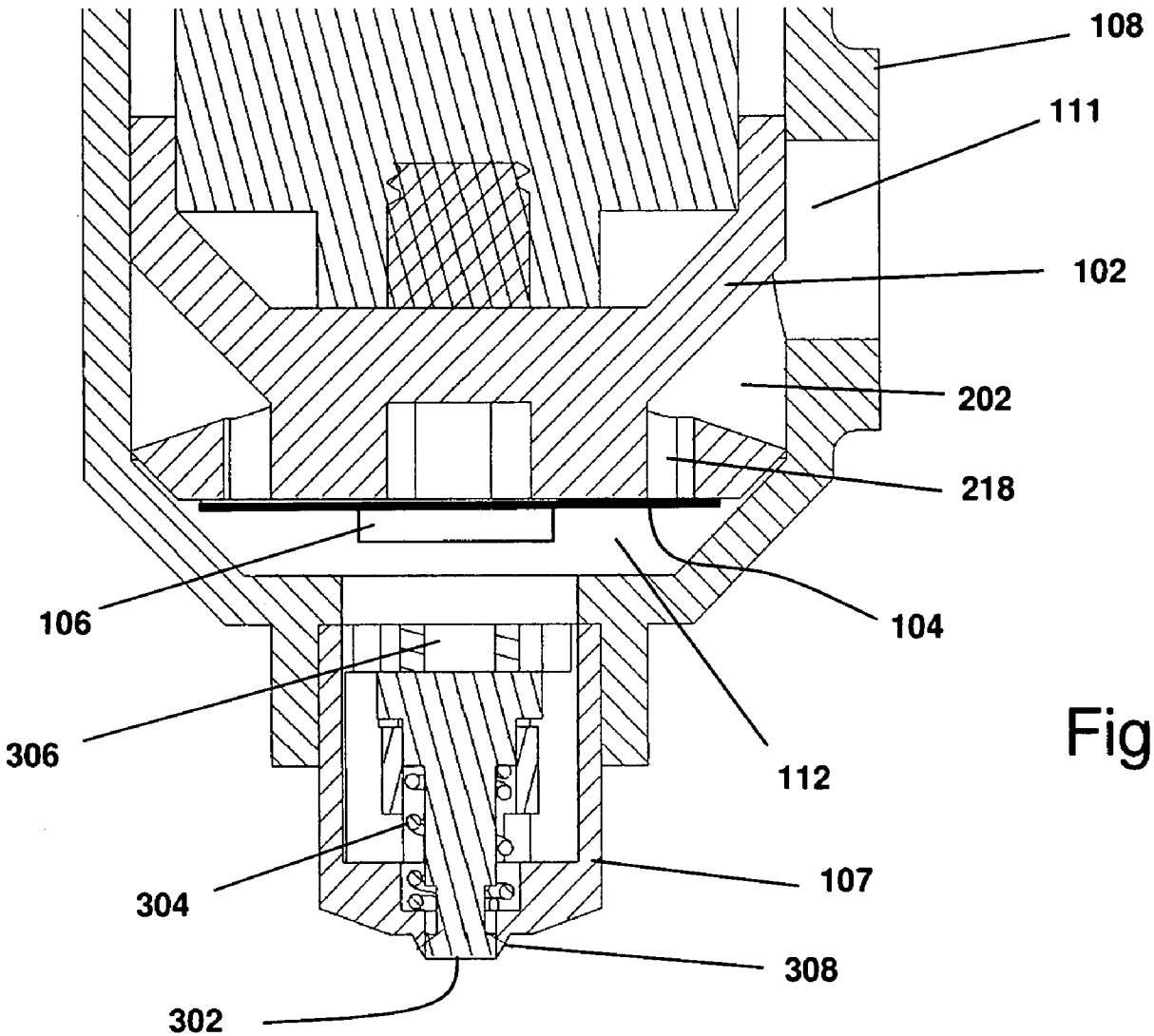
FIG. 4 illustrates a detail cross section view of the lower portion of FIG. 3A.

Two exemplary embodiments are shown in the figures. The first embodiment shown in FIG. 1A-1B and FIG. 2 illustrates a reed valve injection nozzle combination. The second embodiment, shown in FIGS. 3A-3B and FIG. 4 illustrates a poppet valve injector nozzle combination. The detailed embodiments will now be described with respect to the drawings.

FIG. 1A illustrates a cross section view of an exemplary high pressure piezoelectric actuated impulse pump and fuel injector in accordance with the present invention, and FIG. 1B illustrates a perspective view of the injector of FIG. 1A. Referring to FIG. 1A and FIG. 1B, the fuel injector comprises a piezoelectric actuator 101 driving a piston 102 to pressurize fuel in a pressurization chamber 112, forcing the fuel through a reed valve nozzle assembly 103 to be injected into a cylinder. The piezo actuator 101 and piston 102 are fitted within a bore within housing. The housing may be constructed of several casings as is convenient for assembly or repair. As shown in FIG. 1A the housing comprises a main casing 108 having an input port 111 and a precision bore closely matching the piston 102 while allowing free movement of the piston 102. The main casing 108 is fitted with an end cap 105 having a threaded attachment. The end cap 105 secures a mounting plate 109 attached to the piezo actuator 101 against the upper end of the main casing 108. The main casing 108, or alternatively, the end cap 105 may include a cable 113 for electrical connection to the piezo actuator 101. On the lower end, the main casing 108 is threadably attached to a nozzle casing 107 carrying the nozzle assembly.

FIG. 1 illustrates a single input port in accordance with one embodiment of the invention. Alternatively, the input chamber may have two ports, one on each side of the main body, for flow through capability to aid in purging air in the input chamber to prime the injector. As a further alternative, the injector system may include a low pressure pump to keep the injector supplied with fuel. In a further alternative, the injector system may include an intermediate pressure pump to permit the use of a stiffer spring constant on the input reed valve.

FIG. 2 illustrates a detail cross section of the lower portion of FIG. 1A. Referring to FIG. 2, the piston 102 operates within a matching bore in the main casing 108. The piston 102 is aligned with the input port 111 to allow fuel to pass to the input chamber 202 above the bottom face of the piston 102. The piston 102 has a reed valve 104 attached to the pressure face (bottom face) of the piston. The piston has through holes 218 around the periphery of the piston 102 to allow the fuel to pass from the input chamber 202 through the piston 102, between the piston face and the reed valve 104 and into a pressurization chamber 204 below the piston 102. The reed valve 104 is held by a reed clamp 106. The reed valve 104 presents a very light captive force holding the reed 104 in contact with the face of the piston 102. The light captive force permits opening of the reed valve by a slight pressure difference between the input pressure and the pressure of the pressurization chamber. When injecting fuel, however, the reed valve has to withstand pressure differences of up to 3000 psi, (200 bar) or more, has to operate in tens of microseconds and has to have a near zero on to off state displacement because of the very small movement of the piezo actuator.

The piston is preferably a strong, tough, light, corrosion resistant material. Depending on pressure required, steel, stainless steel, titanium, and even aluminum alloys or other materials may be found suitable. As shown in FIG. 1A, the piston is a precision fit to the bore and operates without rings or seals. A precision fit of, for example, 0.001 inch (0.025 mm), or less relative to the diameter is desirable. Alternatively, O-rings or other sealant techniques may be applied. In particular, an O-ring may be placed above the input port between the piston and casing at location 115 indicated in FIG. 1A or a similar location in FIG. 3A. The space 116 between the actuator and casing is preferably maintained free of fuel and preferably contains air to prevent interference with width variations in the actuator that may be associated with length variations used to drive the piston. To prevent gradual filling with fuel, the space 116 may be vented to drain any fuel leakage into space 116.

The lower casing 107 is alternatively referred to as the nozzle casing 107 as this casing includes the nozzle assembly. The nozzle assembly comprises the nozzle casing 107 having a main bore 214 extending to a nozzle bulkhead 216. The bore 214 and nozzle casing 107 are shown longer than necessary in FIG. 2. The extra length may accommodate installation of a pressure sensor or other feature as desired. In an alternative embodiment the bore and nozzle casing may be reduced in length as much as practical. The nozzle bulkhead 216 is bored with feeder holes 210 to the nozzle structure. The nozzle structure comprises an annular conical face 212 machined into the nozzle casing 107. A matching conical reed assembly 103 fits inside the recess and a matching conical section holder 110 (alternatively referred to as a reed cap 110) fills the void and protects the reed valve 103 from damage from the combustion chamber. The holder is attached by a threaded attachment 208 or alternative attachment means as are known in the art. The conical face 212 may have an angle of preferably from 15 to 45 degrees, more preferably 30 degrees from a plane perpendicular to the injector axis 218. In operation, high pressure fuel lifts the reed valve 103 and flows between the reed valve 103 and nozzle conical face 212 and then is injected into the combustion chamber. The high velocity, thin section flow between the matched surfaces 103 and 212 results in very fine atomization of the fuel. The Sauter Mean Diameter (SMD) of the fuel droplets is calculated to be on the order of tens of micrometers.

While there are many competing correlations for SMD, one correlation available in literature is provided below.

$$SMD = .0217D[\mathrm{Re}]^{0.25}[We]^{-0.32}\left[\frac{\mu_l}{\mu_g}\right]^{0.37}\left[\frac{\rho_l}{\rho_g}\right]^{0.32}$$

where,

| | |
|---|---|
| D | is the diameter of the orifice in meters |
| Re | is the Reynolds number |
| We | is the Weber number |
| $\mu_l$ | is the absolute viscosity of the fuel in Newton - seconds per square meter |
| $\mu_g$ | is the absolute viscosity of the gas in Newton - seconds per square meter |
| $\rho_l$ | is the density of the liquid in kilograms per cubic meter |
| $\rho_g$ | is the density of the gas in kilograms per cubic meter |

Using exemplary values:

$$SMD = .0217(50.8\times10^{-6})[3152]^{0.25}[12508]^{-0.32}\left[\frac{1.2\times10^{-3}}{1.8e\times10^{-5}}\right]^{0.37}\left[\frac{804}{1.22}\right]^{0.32}$$

SMD=15.7 μm

In operation, in accordance with one exemplary embodiment, the drive circuit for the piezo actuator is initially at zero volts with the actuator at rest. The input chamber and pressurization chamber are filled with fuel at equilibrium pressure between the input chamber and pressurization chamber and the reed valve is closed. When an injection is initiated, an electrical drive pulse is sent to the actuator causing the actuator to expand. The expansion is small, but very rapid. Typical piezo devices may expand by 1/1000 of the length at maximum drive voltage. Thus, a piezo may expand on the order of, for example, 100 microns (0.1 millimeter) in, for example, 100 microseconds. The pulse is generated as a function of the rising slope of the drive pulse together with the response of the actuator and associated mechanics. The injection may be complete in, for example, 100 microseconds. The drive pulse may continue to hold the drive voltage high as the injection completes. The pulse may be complete in, for example, 100 microseconds and the piezo driver then drops the voltage to the piezo driver according to a desired voltage drop profile. Since the piezo driver has less tensile strength than compressive strength, it is desirable to reduce the voltage at a slower rate than the expansion rate to minimize tensile stress on the actuator. The relaxation of the actuator generates a relative vacuum in the pressurization chamber which opens the input reed valve and allows the fuel to refill the pressurization chamber for a return to the initial at rest conditions. Alternative electrical drive states may include a positive and negative voltage state for compression and expansion or other drive states as appropriate for the chosen piezoelectric material and configuration.

Referring to FIG. 2, beginning with the actuator relaxed at the end of the recharge phase, the reed valve is closed and the piston is moved upward by, for example, 100 microns ready for an injection pulse. When the injection pulse is triggered, the actuator expands by 100 microns pushing the piston down and pressurizing the fuel in the pressurization chamber. The high pressure closes the input reed valve tightly and holds the valve closed. The pressurized fuel flows through the passages in the nozzle bulkhead and presses on the nozzle reed valve to open the nozzle reed valve and flow guided by the conical reed valve and seat to be injected into the cylinder according to the angle of the reed valve and seat. The injection reed valve is a relatively stiff high pressure reed valve that opens very little under the injection pressure to keep the gap between the reed valve and the seat very small forcing the fuel to greatly accelerate through narrow dimensions to generate a fine mist upon injection into the cylinder.

At the end of the 100 microsecond injection pulse phase, the injection reed valve closes. The drive voltage then decays, allowing the piezo actuator to return to the relaxed length. As the piston moves upward, the input reed valve opens due to partial vacuum in the compression chamber combined with any pressure available in the input chamber. Fuel then flows to fill the pressurization chamber until equilibrium is established, at which point, spring forces in the reed valve close the reed valve and the process repeats again for the next injection pulse.

In a further advantage of the position of the reed valve on the piston, the reed valve is positioned so that the inertia of the reed valve works to enhance the operation of the reed valve. As the piston accelerates downward to compress the compression volume 112, the inertia of the mass of the reed valve presses the reed valve against the piston, closing and sealing the reed valve. Thus, the inertia of the reed valve works to enhance the closing pressure provided by the back pressure of the pressurized volume 112. When the piston accelerates upward, the inertia of the reed valve acts to open the reed valve, enhancing the action provided by the pressure differential between the input chamber and pressurization chamber and increasing the fuel flow into the pressurization chamber.

FIG. 3A illustrates a cross section view of an alternative exemplary high pressure piezoelectric actuated impulse pump and fuel injector in accordance with the present invention, and FIG. 3B illustrates a perspective view of the injector of FIG. 3A.

FIG. 4 illustrates a cross section view of the lower portion of the injector of FIG. 3A. Referring to FIG. 3A, FIG. 3B and FIG. 4, the injector of FIG. 3A is similar to the injector of FIG. 1 in that the piezoelectric actuator drives a piston. The piston 102 has a reed valve 104 located thereon for reducing back flow during the pulse operation. The piston 102 pressurizes the fuel in a pressurization chamber 112 and the pressurized fuel forces open a nozzle valve 302. The nozzle valve 302 is integrated with the injector spray nozzle 308 to cooperatively deliver the atomized fuel in a desired pattern in response to the fuel pressure spike from the piezo actuator. Detail differences can be found in the piston 102 and actuator 101. A significant difference is to be found in the injector valve. The injector of FIG. 3A has a poppet valve 302 with a spring 304 return and support insert 306. Like the reed injector valve 308 of FIG. 1A, however, the poppet valve 302 also has conical valve surface and seat to produce a fine mist and direct the mist in a particular pattern. The valve stem 302 has a conical surface mating with a conical seat in the housing 107. The valve is opened just sufficiently to release the desired fuel amount. The fuel is accelerated through the narrow passages at the valve exit to produce the fine mist injection. One advantage of the poppet valve embodiment is the small area of the valve exposed to the harsh combustion chamber environment and the small area subject to back pressure effects from the combustion chamber.

Injection Pressure

The injection pressure is a primary sizing requirement for direct fuel injection (DFI) systems, as is injection volume. Given that the maximum actuation distance, $D_{xactuator}$, for a given actuator is fixed, the maximum injection pressure also is an inverse function of the maximum injection volume, $V_{max}$ due to the elasticity of the actuator.

$$p_{injector_actuator} = \frac{F_{actuator}}{A_{actuator}}$$

$$p_{injector_actuator} = \frac{F_{actuator}}{(V_{max}/\Delta x_{actuator})}$$

Figure 5:
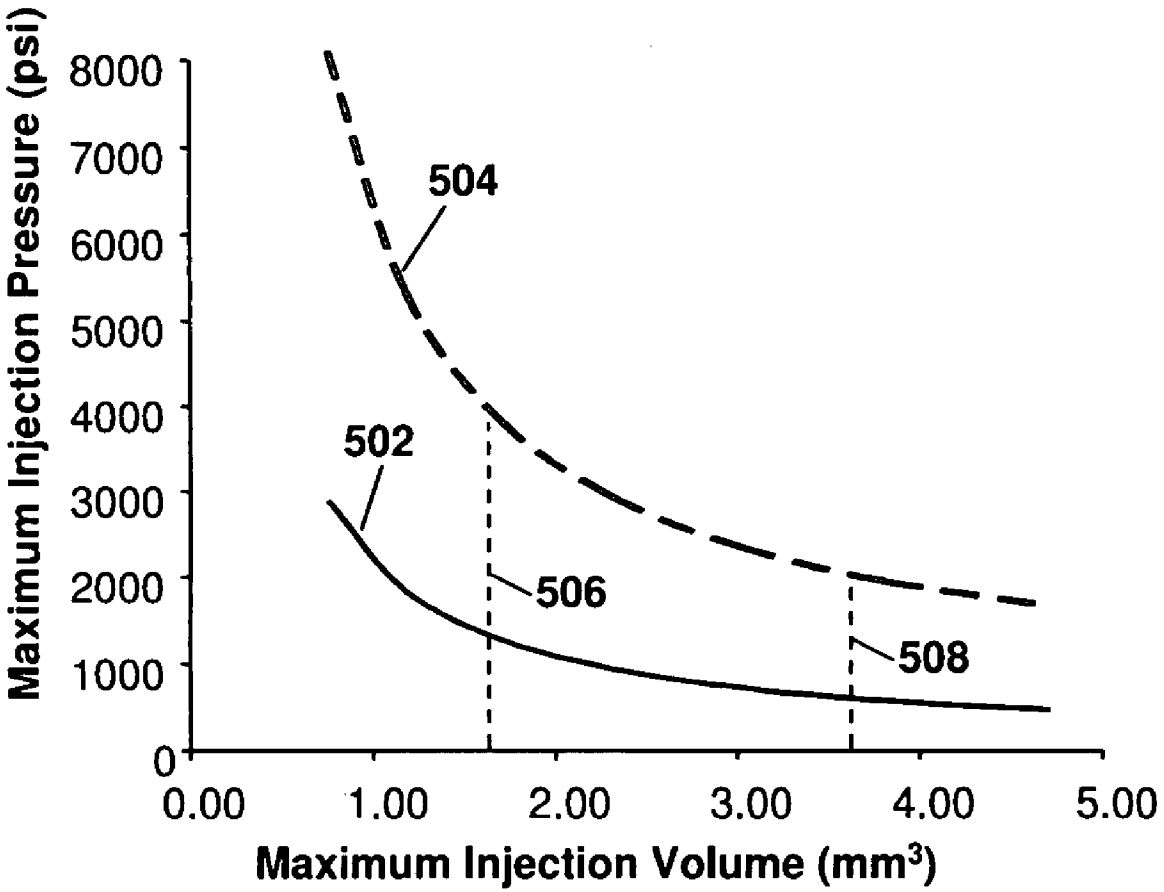
FIG. 5 shows the relationship between the maximum injection pressure and volume for exemplary fuel injectors in accordance with the present invention.

FIG. 5 shows the relationship between the maximum injection pressure and volume for exemplary fuel injectors in accordance with the present invention. Referring to FIG. 5, the solid line 502 uses a commercially available piezoelectric actuator. The dashed line 504 reflects a higher force actuator that is within the current technology limits. Injection volumes 506 and 508 represent two exemplary designs presently contemplated. While piezoelectric actuators are available that can produce even higher pressures, reducing the injection pressures minimizes the size of the actuator and eases performance tolerances.

The maximum injection pressure of the exemplary embodiment is 638 psi. However, if needed, injection pressures could be increased to 4000 psi and potentially approach 10,000 psi. At such high pressure, the lower injection volume per injection may be compensated by scheduling multiple injections per engine revolution. The pressures shown in FIG. 5 are significantly greater than the 15-30 psi injection systems found in automotive port fuel injection systems and other small engine fuel injection systems. While piezoelectric actuators are available that can produce even higher pressures, the reduced injection pressure simplifies the design.

Figure 6:
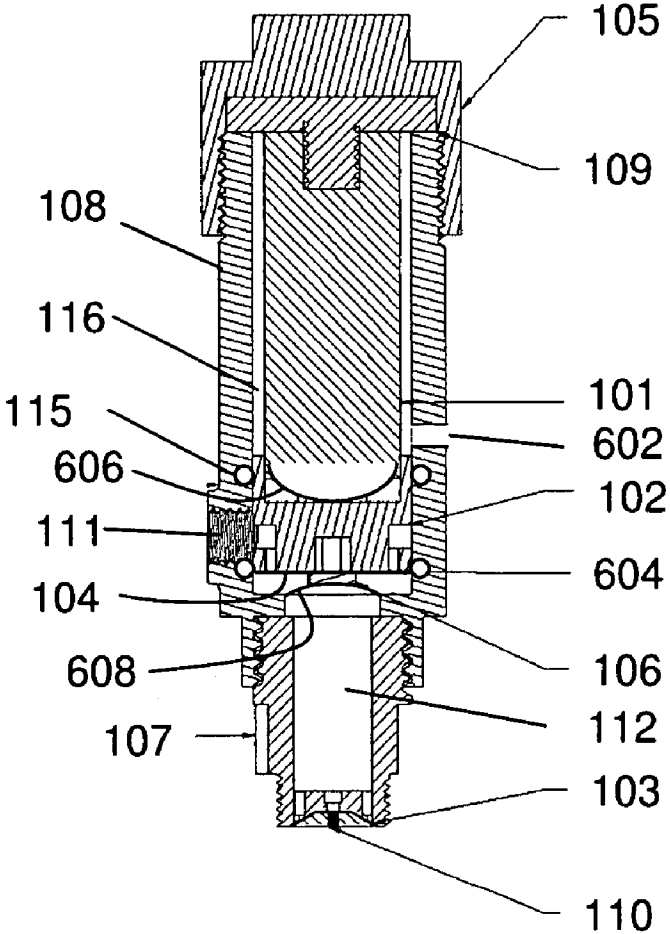
FIG. 6 illustrates the high pressure piezoelectric fuel injector of FIG. 1A including alternative features.

FIG. 6 illustrates the high pressure piezoelectric fuel injector of FIG. 1A including alternative features. Referring to FIG. 6, the actuator 101 operates the piston 102 as in FIG. 1A. FIG. 6 further illustrates the sealing of the space 116 between the actuator 101 and the casing 108. Depending on the actuator 101, driving the actuator 101 to change the length of the actuator may also change the width of the actuator. If fluid fills the space 116 between the actuator 101 and casing 108, then the change in width will couple to the casing. The coupling will influence the drive impedance and loading on the actuator and thus may influence the length change or length change rate effected for a given drive pulse. Thus, it is desirable for the side space 116 loading to be constant, i.e. not to have a variable amount of fluid. In one embodiment, the side space is allowed to fill with fuel. In a preferred embodiment as shown in FIG. 6, the side space is an air space. A sealing means is shown as an O-ring 115 to prevent the fill of the side space 116 with fuel and to decouple width changes of the actuator 101 from the compression volume 112. The side space 116 may also include a vent 602 do drain any fuel that may leak into the side space 116, especially as the injector ages. In an alternative embodiment (not shown), the side space 116 may be continuous with the compression volume 112 and the injector may or may not have a piston 102. In the continuous embodiment, the compression volume would be responsive to the bulk expansion of the actuator and not so much to the length. In the preferred embodiment of FIG. 6, the compression volume is responsive to the length changes and decoupled from the width changes. Coupling the compression volume to the length changes of the actuator permits greater actuation volume for a given actuator because typically the width dimension decreases as the length dimension increases, reducing the bulk volume change. Further, the use of the piston 102 and placing the reed valve 104 on the piston 102 allows the compression volume 112 to be made as small as practical. Preferably, the largest dimension of the compression volume should be less than % wave at the highest principle frequency component of the drive waveform, i.e., associated with the rise time of the pulse. Keeping the compression volume small helps reduce acoustic bounces for more consistent injection volumes.

FIG. 6 shows an O-ring 604 for further sealing between the input chamber 202 and the compression chamber 112. Any leakage during the compression interval takes away from potential delivered injection volume. FIG. 6 also shows a dome coupling 606 between the actuator 101 and piston 102. The dome provides axial coupling without coupling rotationally, either around the actuator length axis or a perpendicular (tilt) axis, thus minimizing any tension stress that may lead to cracks and failure of the actuator. A Bellville spring 608 with flow through holes is provided to keep the piston in contact with the dome.

Figure 7:
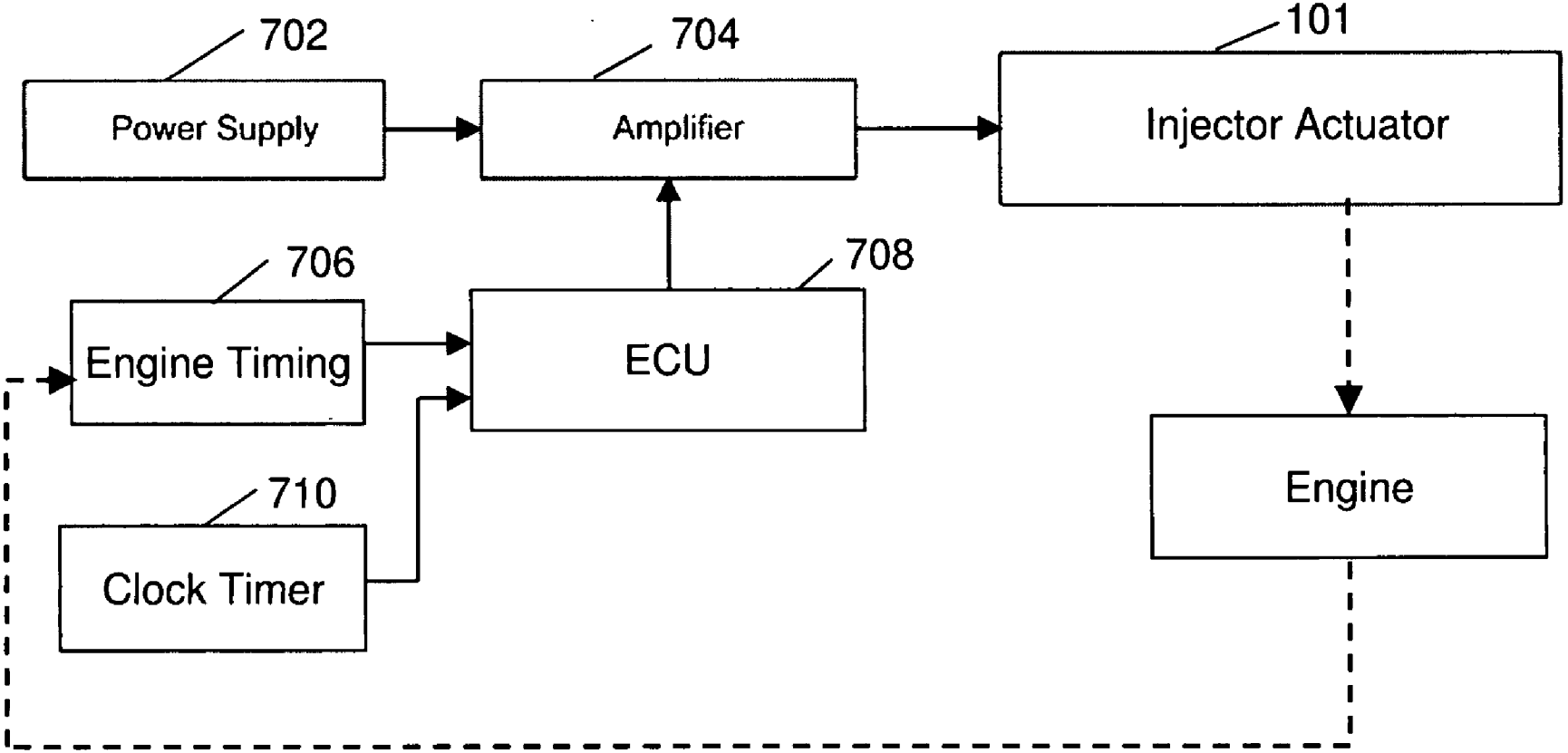
FIG. 7 is a block diagram representing an exemplary drive system for the injector of the present invention.

FIG. 7 is a block diagram representing an exemplary drive system for the injector of the present invention. Referring to FIG. 7, an electronic computer unit (ECU) 708 receives timing information 706 relating to crank shaft angle and stroke for each cylinder. The computer 708 may use clock timing information 710 to interpolate between crank shaft angle events and to develop RPM information as needed by a timing algorithm. The computer then calculates the desired pulse timing in accordance with the timing algorithm and generates a pulse waveform. The pulse waveform is then amplified by amplifier 704 and delivered as a drive pulse to each injector actuator 101.

Figure 8:
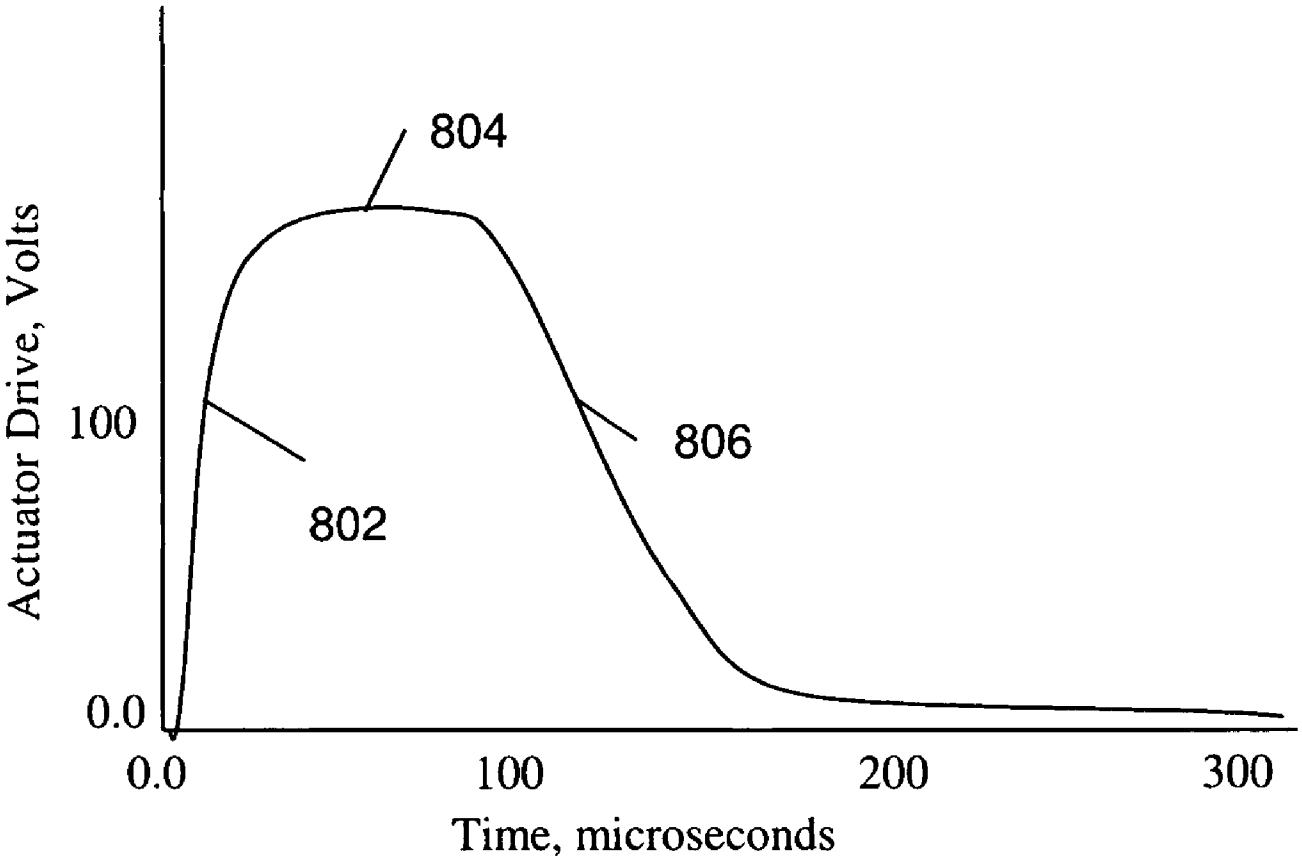
FIG. 8 illustrates an exemplary drive pulse for an actuator in accordance with the present invention.

FIG. 8 illustrates an exemplary drive pulse for an actuator in accordance with the present invention. Referring to FIG. 8, the drive pulse for a single injection comprises a positive pulse having a rising edge 802, a peak hold period 804, and a falling edge 806. The rising edge 802 has a rise time reflecting the time to achieve a percentage, for example 90% of the peak. The extension of the actuator 101 may follow the rising edge of the drive pulse with some delay according to the elasticity of the actuator and the mechanical load (including, among other things, the piston 102, pressurization chamber 112, and injection valve 104.) During the rising edge portion 802, the actuator compresses the fuel and the injection valve opens. As the voltage approaches the peak, the rate of rise slows and gradually transitions to a steady level 804 for a period of time. The actuator finishes extension during this time, and the fuel is injected. As fuel is injected, the pressure drops and the injection valve closes. The drive voltage then transitions to the falling edge 806, during which the actuator contracts to the relaxation state, the input reed valve opens and fuel is admitted to the pressurization chamber. The falling edge 806 may be slower than the rising edge 802 and the transitions from rising edge to peak hold and from peak hold to falling edge may be rounded to reduce tension stress in the actuator. Alternatively, or in combination, the actuator may be constructed with a mechanical (spring loaded) compressive preload to reduce tension stress. The graph of FIG. 8 is somewhat idealistic to illustrate the principles. In practice, overshoots and ringing may be typically found in an actual voltage plot. The specific voltages and associated currents depend on the actuator design. An actuator may be fabricated of a stack of actuator components wired in parallel for a lower voltage, higher current embodiment. Typically the amount of fuel injected may be varied by varying the peak voltage of the drive pulse up to a maximum allowable for the actuator. If more fuel is needed, a larger actuator may be provided, or alternatively, multiple injections per stroke may be provided. The typical repetition rate is a function of the rotation rate of the engine. Typical small engines may run at 200 to 10,000 revolutions per minute (RPM) with one injection for each two revolutions.

Injector Reed Valve

FIGS. 9A-12 illustrate further details of the exemplary reed valve injection nozzle of FIG. 2 in accordance with the present invention.

Figure 9A:
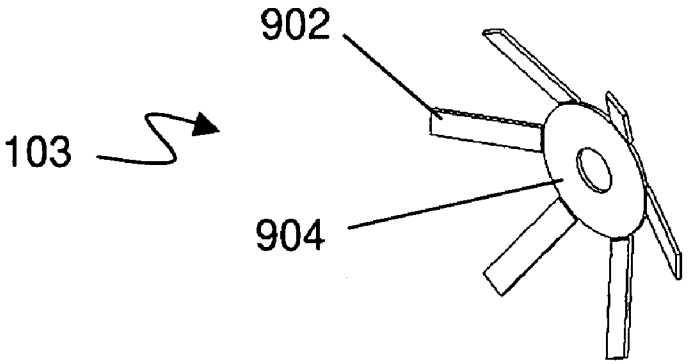
FIG. 9A, FIG. 9B, and FIG. 9C illustrate an exemplary reed assembly comprising six reeds in accordance with the present invention.
Figure 9C:
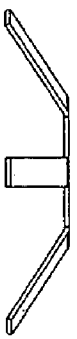
Figure 9B:
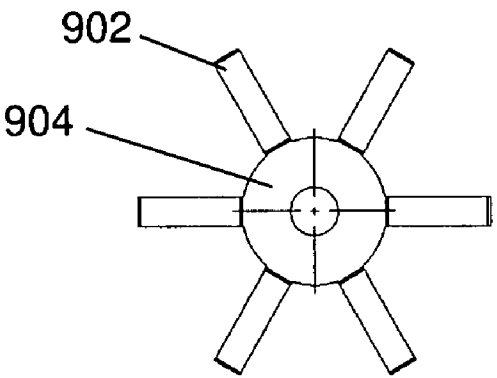

FIG. 9A, FIG. 9B, and FIG. 9C illustrate an exemplary reed assembly comprising six reeds in accordance with the present invention. FIG. 9A is an isometric view. FIG. 9B is a bottom view. FIG. 9*c* is a side view. Referring to FIGS. 9A-9C, the exemplary reed assembly is made out of blue tempered 1095.004 inch thick spring steel sheet. In FIG. 9A, the reed valve "fingers" are 0.024 inches by 0.100 inches. Six fingers extend from a central hub that is 0.056 inches radius.

Figure 10:
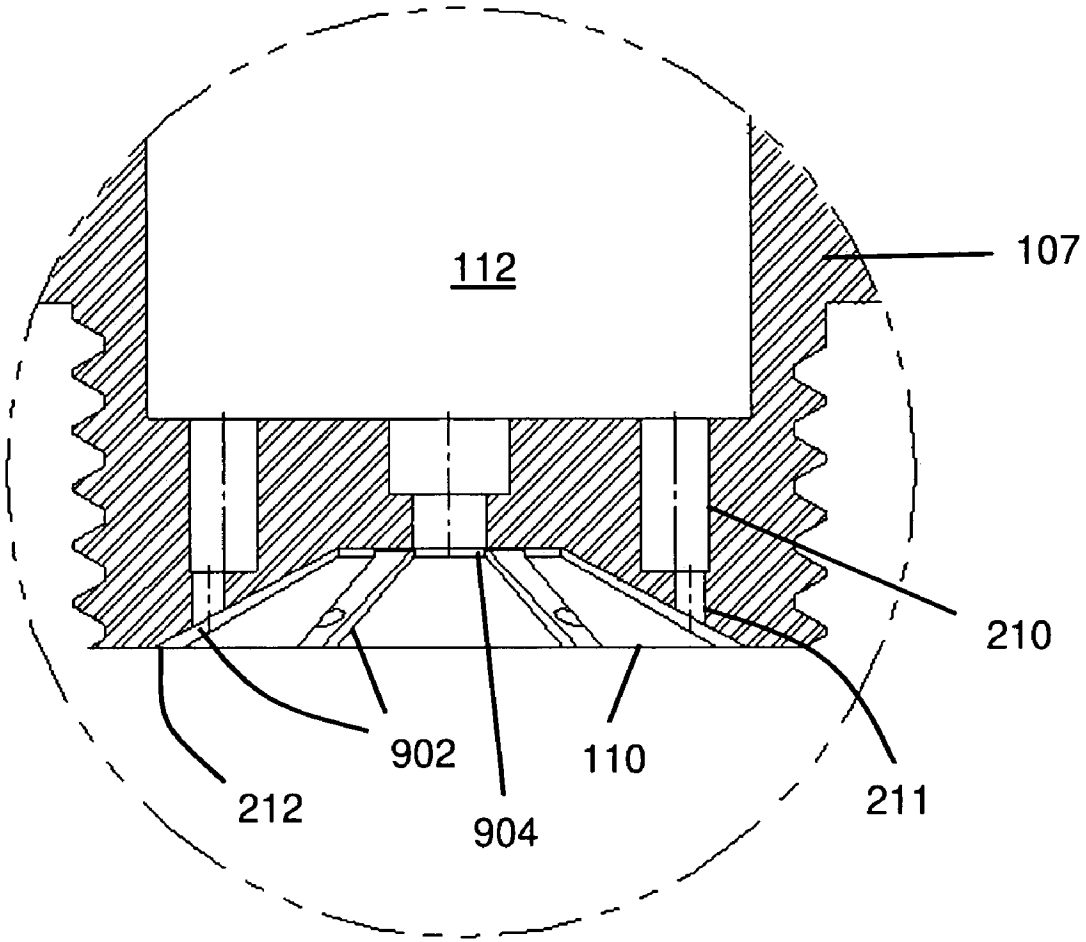
FIG. 10 illustrates a magnified view of a portion of FIG. 1A showing detail of the reed injector structure.

FIG. 10 illustrates a magnified view of a portion of FIG. 1A showing detail of the reed injector structure. FIG. 10 shows the nozzle casing 107, reed assembly 103 (comprising reed fingers 902 and hub 904), and reed cap 110. Within the nozzle casing 107 is shown the pressurization chamber 112, and leading from the pressurization chamber are the nozzle feed bores 210 followed by the injection holes 211. The reed valve is formed by the reed fingers 902 seating against the nozzle casing 107 at the injection holes 211. The reed cap 110 limits the travel of the reed fingers 902 away from the seat and establishes a narrow channel between each reed finger 902 and the injector casing 107 for rapid acceleration of the fuel to produce fine atomization.

Figure 11:
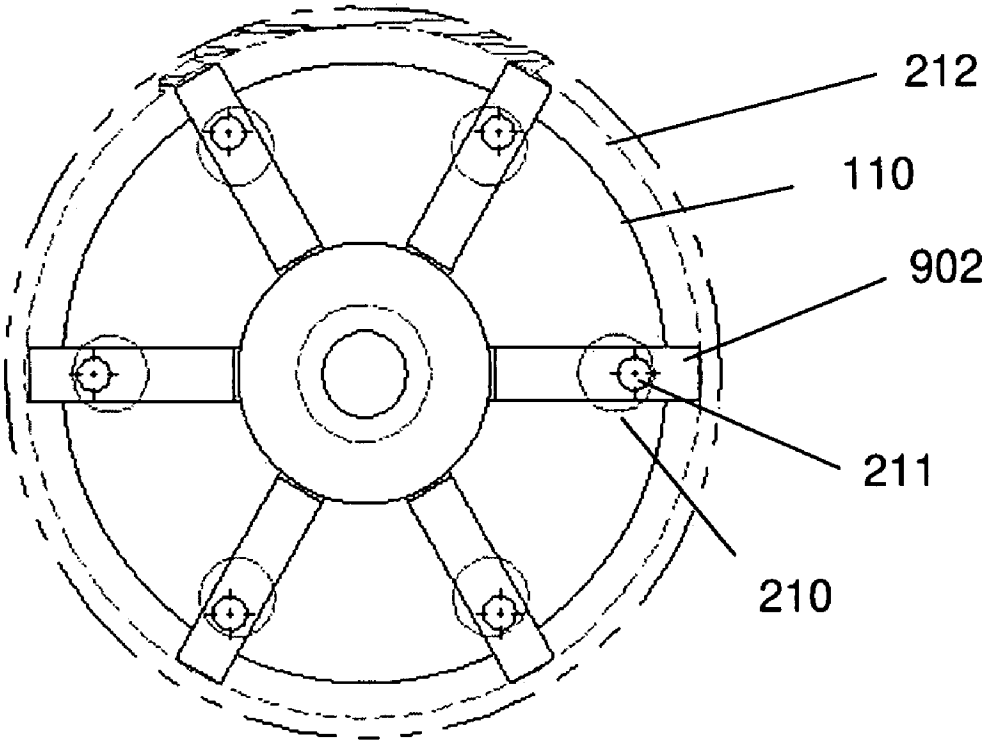
FIG. 11 is a bottom view of the assembly of FIG. 10.

FIG. 11 is a bottom view of the assembly of FIG. 10. FIG. 11 shows the alignment of the various elements shown in FIG. 10. Shown are the positions of the reed fingers 902, injector holes 211, nozzle feed bores 210, reed cap outer diameter 110, and injector conical cavity 212.

Figure 12:
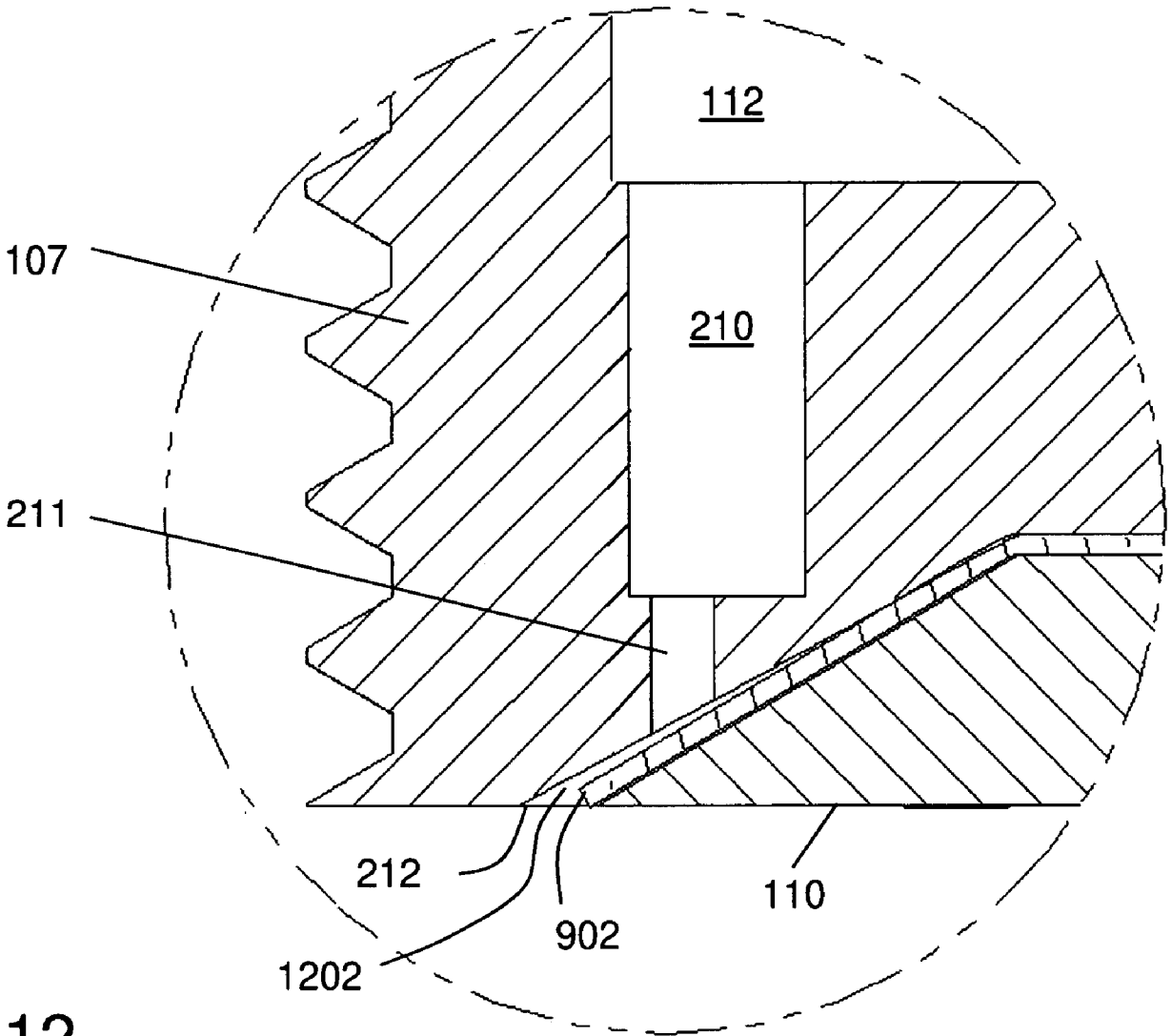
FIG. 12 shows a further magnification of a portion of FIG. 10 showing in greater detail the arrangement of the components if the nozzle.

FIG. 12 shows a further magnification of a portion of FIG. 10 showing in greater detail the arrangement of the components if the nozzle. Referring to FIG. 12, the positions of the nozzle casing 107, reed finger 902 and reed cap 110. Shown is the conical seat 212 for the reed fingers and a gap 1202 formed when the fuel forces the reed valve open and forces the reed 902 against the reed cap 110. Note that the reed cap 110 presents a limiting surface for the movement of the reed 902 that is parallel to the deflected position of the reed. Note that all six reeds may conform to the single conical surface of the reed cap.

The exemplary injection holes are 0.016 inches in diameter. The gap between the valve seat and cap is 0.008 inches to allow a 0.004 inch maximum movement of the reed. Using the cap to restrict the movement, both improves the injector valve response time at the end of the injection pulse and also controls the effective nozzle diameter and thus improves atomization. The cap 110 also protects the reed 902 from combustion chamber pressure and temperature.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A high pressure fuel injector for direct injection of fuel into a cylinder of a compression ignition engine, said fuel injector comprising:

a piezoelectric actuator disposed within a rigid housing, said piezoelectric actuator having a first end seated against said housing at a distal end and a second end operatively coupled to a piston movable within a bore within said housing;

said housing having a fuel input port and passage formed in said housing, said passage coupling said fuel to an inlet side of said piston; said piston having an input check valve formed thereon to allow passage of fuel from said input chamber to a pressurization chamber on a pressurization side of said piston;

said pressurization chamber coupled to a nozzle assembly; said nozzle assembly having a spring loaded member pressing against a conical seat at a conical angle;

wherein during operation, the piezoelectric actuator is driven by an electrical pulse causing the piezoelectric actuator to lengthen, driving the piston toward the nozzle assembly, closing the input check valve, and generating a high pressure in the pressurization chamber; the high pressure is coupled through said fuel to the spring loaded member and deflects the spring loaded member open allowing a portion of said fuel to exit between the spring loaded member and the conical seat, dispersing said portion of said fuel in accordance with said conical angle of said conical seat.

2. The high pressure fuel injector of claim 1, wherein the spring loaded member comprises a reed valve conformal to the conical seat.

3. The high pressure fuel injector of claim 2, wherein the nozzle assembly includes adjustable spring tension.

4. The high pressure fuel injector of claim 1, wherein the spring loaded member comprises a poppet member having a matching surface for said conical seat.

5. The high pressure fuel injector of claim 1, wherein the input check valve is an input reed valve comprising a reed and a seat and the seat is formed in the piston comprising flow through holes in the piston sized to prevent fatigue stress in the reed.

6. The high pressure fuel injector of claim 1, wherein a width variation of said actuator in response to said electrical pulse is decoupled from affecting said high pressure in said pressurization chamber by a close fitting of said piston in said bore.

7. The high pressure fuel injector of claim 1, wherein said actuator is disposed within a gas filled chamber.

8. The high pressure fuel injector of claim 7, further including a seal between the gas filled chamber and the input chamber.

9. The high pressure fuel injector of claim 8, wherein the seal between the gas filled chamber and the input chamber is an O-ring.

10. The high pressure fuel injector of claim 7, further including a vent providing communication between said gas filled chamber and air outside said gas filled chamber.

11. The high pressure fuel injector of claim 1, wherein leakage between said piston and said input chamber is controlled by said piston having a close fit within said bore.

12. The high pressure fuel injector of claim 1, wherein said close fit is a diameter within 0.025 millimeter relative to the diameter of said bore.

13. The high pressure fuel injector of claim 1, wherein said coupling from said actuator to said piston allows for tilt rotational freedom of motion of said piston relative to said actuator.

14. The high pressure fuel injector of claim 1, wherein the opening and closing of the input valve is enhanced by the inertia of a valve component.

15. A method of operation of a fuel injection device for providing high pressure fuel injection into a combustion chamber of a direct injection compression ignition engine comprising the steps of:

said fuel injection device receiving fuel into an input chamber on a first side of a piston;

moving said piston in response to piezoelectric actuator to reduce the volume of said input chamber and force an amount of fuel through said piston to a pressurization chamber on a second side of said piston;

closing an input reed valve disposed on the second side of said piston to prevent a return of said first amount of fuel to said input chamber through said piston;

moving said piston in response to said piezoelectric actuator, said moving said piston reducing the volume of said pressurization chamber and generating an increased pressure within said pressurization chamber;

said increased pressure within said pressurization chamber coupling to an injection valve and opening said injection valve allowing a portion of said fuel to pass from said pressurization chamber to said combustion chamber.

16. The high pressure fuel injector of claim 15, wherein the injection valve includes at least one reed valve.

17. The high pressure fuel injector of claim 16, further including the step of: restricting a movement of said at least one reed valve by a reed cap having a surface disposed parallel to a displaced position of said at least one reed.

18. The high pressure fuel injector of claim 15, wherein the injection valve comprises a poppet valve.

19. The high pressure fuel injector of claim 15, wherein the input check valve comprises at least one input reed valve comprising a reed and a seat and the seat is formed in the piston, said at least one input reed valve further comprising at least one corresponding flow through hole in the piston sized to prevent deformation of said reed leading to failure of said reed.

20. The high pressure fuel injector of claim 15, wherein said actuator is disposed within a gas filled chamber.

* * * * *